US007758050B2

(12) United States Patent
Denoual

(10) Patent No.: US 7,758,050 B2
(45) Date of Patent: Jul. 20, 2010

(54) TWO LEVEL SHUT THE BOX GAME

(76) Inventor: Thierry Denoual, 30 rue, Fresnay, Saint Gabriel, Brecy (FR) F-14480

( * ) Notice: Subject to any disclaimer, the term of this patent is extended or adjusted under 35 U.S.C. 154(b) by 153 days.

(21) Appl. No.: 11/856,956

(22) Filed: Sep. 18, 2007

(65) Prior Publication Data

US 2009/0072482 A1 Mar. 19, 2009

(51) Int. Cl.
*A63F 1/02* (2006.01)

(52) U.S. Cl. ..... 273/393

(58) Field of Classification Search ..... 273/393
See application file for complete search history.

(56) References Cited

U.S. PATENT DOCUMENTS 1,466,534 A * 8/1923 Kuen ..... 273/268
1,578,554 A * 3/1926 Seligman ..... 273/153 R
3,871,660 A * 3/1975 Estes ..... 273/272
4,410,182 A * 10/1983 Francis ..... 273/268
4,421,315 A * 12/1983 Cutler ..... 273/268
D323,859 S * 2/1992 Russell ..... D21/372
6,378,868 B1 * 4/2002 La Bossiere ..... 273/272
6,942,218 B2 * 9/2005 Davis et al. ..... 273/268
7,118,110 B2 * 10/2006 Kowalczyk ..... 273/272

* cited by examiner

*Primary Examiner*—Gene Kim
*Assistant Examiner*—Dolores Collins
(74) *Attorney, Agent, or Firm*—Craig M. Stainbrook; Stainbrook & Stainbrook, LLP

(57) ABSTRACT

An improved game of Shut the Box, including a game box and front and back rows of tiles in which tiles are pivotally arrayed in a side-by-side relationship. Each tile bears a number and may be selectively placed in either a vertical orientation so as to show the tile face or a horizontal orientation so as to obscure the tile face. The back row of tiles is positioned immediately behind and above the front row such that each one of the back row tiles is directly behind a corresponding front row tile. For any given pair of front and back row tiles, when the front row is in the vertical orientation, the face of the corresponding back row tile is obscured, and when the front row tile is in the horizontal position, the back row tile is revealed if it is in its vertical orientation. When both the front row tile and the back row tile are in the horizontal orientation, the face of each is obscured. The game is played with dice.

1 Claim, 3 Drawing Sheets

TWO LEVEL SHUT THE BOX GAME

CROSS REFERENCES TO RELATED APPLICATIONS

NA. The present application is an original and first filed United States Utility Patent Application.

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

The present invention relates generally to dice games, and more particularly to combination dice and board games, and still more particularly to an improved version of the well-known game of Shut-the-Box, which employs two levels of horizontally placed tiles numbered 1 through 9, which singly or additively correlate to the indicia or pips revealed on a par of dice after a throw.

2. Discussion of Related Art Including Information Disclosed Under 37 CFR §§1.97, 1.98:

Dice are the oldest gaming implements known to man. Their precise origins are unknown but they have a long and rich history nonetheless. Sophocles (496-406 BC), the Greek poet, claimed that dice were invented by Palamedes during the siege of Troy. Herodotus (b. 484 BC?), historian and an acquaintance of Sophocles, claimed that they were invented by the Lydians of Asia Minor. Both wise men were wrong, as dice date back even further than this. Egyptian tombs dating to 2000 BC have been found containing dice. Dice reputedly dating to 6000 BC have been uncovered in archaeological excavations.

Dice were developed independently by many ancient cultures around the world and did not simply originate and spread from any one place. In ancient times the throw of a dice was not just considered to be luck, the outcome was believed to be controlled by the gods, and casting dice was used to make decisions about dividing inheritances, choosing rulers, and in divination and prognostication. In ancient Rome, the goddess Fortuna, daughter of Zeus (known to gamblers as Lady Luck), was believed to determine the outcome of a throw.

Before standard cubical dice became common, ancient peoples would use fruit stones, sets of flat sticks, sea shells, nut shells, and pebbles to generate random results for games. These were probably adopted from witch doctors and shaman who would throw them to gain insight and knowledge of the unknown and things to come. Animal knucklebones were the next step in the evolution of dice. The Greeks and Romans used sheep anklebones as well as the more developed cubical spotted dice. The Romans called the four-sided anklebones Tali or Astaragali and the standard six-sided dice Tesserae.

The Arab word for knucklebones is the same as that for dice, and playing with dice is known as "rolling the bones" to this day.

Of course, many games have always been played with dice, the dice being employed as random number generators. The pharaohs of ancient Egypt were portrayed playing dice and both the Romans and Greeks were keen dice players. Roman Emperors notoriously played and gambled with dice compulsively. Dice games are known to have been popular in Europe during the Middle Ages. In England, both Richard the Lion Heart and King John gambled with dice, and King Henry VIII lost the bells of old St Paul's church on a roll of the dice.

Dice games have been played in English inns since at least the 15th century. Dominoes descended from dice in China and spread to the Occident in the 18th century, while standard dice became the vital component of a vast array of commercial board games in the 19th and 20th centuries.

Dice games have been especially successful in the arena of gaming and so-called "pub games." Most such games involve a wager of some sort, a drinking dare, perhaps, or a monetary stake. Games employing dice include such well known board games as backgammon. Another is Shut the Box, the dice and board game upon which the present invention improves.

It is not known with certainty where or how Shut the Box originated, though the most credible accounts suggest an origin in Northern France and identify Normandy or the Channel Islands as the cradle. It appears that it has been played in this region for at least two hundred years and is especially popular among sailors and fishermen. Evidence of the game in England has but a recent history, dating back only to the middle of the twentieth century, and since most games of like kind are referred to in a variety of literature, the absence of such references seems a good indicator that the game did not originate in England. In fact, Timothy Finn in his "Pub Games of England" says that the game was brought to the South of England from the Channel Islands as recently as 1958.

Apparently, Shut the Box has several names, one of which is Canoga. An old pub gambling favorite, traditional Shut the Box uses two dice and a special wooden playing tray. The tray features the numbers 1-9 in a row, each of which has a hinged tile with a number that can be flipped to obscure (or "shut") the number. Sliding a cover over the number is an alternative way to obscure or shut the number. A player's turn involves repeatedly throwing the dice and shutting or covering a number or numbers after every throw, the numbers selected by matching the number total with the total pips showing on the dice thrown. The turn ends when no numbers can be covered upon the throw of the dice, at which point the player's total is calculated. The overriding goal is to completely cover all numbers or "shut the box" which results in the best possible score of zero.

The drawback of the original game is that it can end rather quickly, perhaps as little as 15 seconds, if the dice are especially uncooperative. Additionally, strategies are limited with but one set of nine numbers.

Games related to Shut the Box have been devised. Most notable among them is U.S. Pat. No. 6,942,218, to Davis, et al., which discloses a domino and dice game having a series of dominos that correspond to the possible counts generated by a pair of conventional cubical dice. The dominos are initially positioned face up, and the dice are tossed. Dominos having counts corresponding to the resulting count on the dice, are turned face down. Play continues by a single player until no more domino moves are possible, whereupon play transfers to the next player. Scoring is made according to the number of pips displayed on the remaining face up dominos after a turn is completed, with low score winning the round after all players have played. The game also includes a playing box having at least one row of dominos pivotally secured across the box and a dice tossing area. The playing box may include additional domino rows for doubles and blank dominos, if desired. It is respectfully submitted, however, that the '218 patent does not disclose, teach, suggest, show, or otherwise render obvious the invention described herein.

BRIEF SUMMARY OF THE INVENTION

The present invention is an improved version of Shut the Box, called Two Level Shut the Box. The game utilizes two conventional cubic dice in combination with two rows of tiles housed in a gaming box. Each of the tiles bears a mark. A front row of tiles preferably bears numbers 1, 2, 3, . . . n, read from left to right. A back row bears the same numbers in reverse sequence n . . . 3, 2, 1, read left to right (stated differently, 1, 2, 3, . . . n read right to left). In a first preferred embodiment, the numbering read left to right is 1-9 in the front row and 9-1 in the back row. However, it will be appreciated that the numbering could include either higher counts or lower counts, as desired, but in all instances the number of tiles in the back row equals the number of tiles in the front row. Furthermore, third, fourth, and even fifth and sixth rows could be added, all lined up precisely behind the row in front. For higher row counts, regardless of the number of rows, more die must be employed, as will be appreciated from the playing rules, set out in detail below.

All of the tiles are pivotally mounted proximate their base on an axle or rod, and each tile in the rows may be flipped, pivoted, or rotated on the rod into a face down (number down) orientation. The parallel horizontal positioning of the tiles allows the back row of tiles to be obscured by the front row of tiles, until a tile in the front row has been flipped or obscured. As will be immediately appreciated, the extra row of tiles facilitates a longer game than the original Shut the Box, and it provides opportunities for deploying a more interesting and varied strategy, all without sacrificing the simplicity of the original game. Spacers are interposed between adjoining tiles to keep tile spacing even and to facilitate ease of movement of each tile on the pivot rod. The positioning of the tiles is such that each of the tiles in the first row of tiles, when in the vertical position, obscures the number on the face of the tile directly behind it. This arrangement means that the front row tile inscribed with the number "1" obscures the corresponding back row tile inscribed with the number "9." When the front row tile with the inscription "1" is flipped down and into the horizontal position, the back row tile with the inscription "9" is revealed.

This orientation applies to each number in the sequence; namely, front row tile 2 covers back row tile 8; front row tile 3 covers back row tile 7; front row tile 4 covers back row tile 6; front row tile 5 covers back row tile 5; front row tile 6 covers back row tile 4; front row tile 7 covers back row tile 3; front row tile 8 covers back row tile 2; and front row tile 9 covers back row tile 1.

A horizontal ledge supports the tile when in the horizontal position to maintain a static position in the horizontal plane. A dice field area is located below and in front of the lower row of tiles. This area is where the dice are tossed during a player's turn.

Two Level Shut the Box can be played by any number of players, though it is most enjoyable with two to four players. A round of the game consists of each player taking one turn. A player's takes a turn by repeatedly throwing the dice until the player cannot continue. Each throw of the dice proceeds as follows:

If the total of the tiles still standing is equal or inferior to 6, then the player has the possibility of only using one die. The player throws the die or dice into the box and adds up the pips. The player must then cover up a set of unique uncovered numbers that add up to the sum thrown. Thus, for instance, if the total pips showing on the dice is 8, the player may choose one of the following sets of numbers as long as all of the numbers in the set are available to be covered:

8
7 and 1
6 and 2
5 and 3
5 and 2 and 1
4 and 3 and 1

Additionally, the player may elect to flip tiles from both the front and back rows. For instance, assuming, again, that the dice throw yields 8, the player may flip 4 from the front row and 4 from the back row, the general principle being that back row tiles may be flipped when available, if exposed from prior turns or even within a particular turn.

The player repeats this process with subsequent throws. Once a number in the front row has been flipped forward, it reveals a tile in the second (upper) row. Once a back row number is revealed, it may be used as a combination in the next throw. Eventually, the player will throw a total for which it is not possible to find a set of uncovered numbers. When this happens, the player scores the sum of the numbers remain uncovered. Accordingly, if the numbers 1, 5 and 9 are uncovered and the player throws a 4, with options 4 or 3 and 1, the turn finishes and the player's score is 15.

If any player succeeds in shutting the box—flipping all the numbers—that player wins immediately. Otherwise, after each player has taken one turn, the winner of the round is the player with the lowest score.

It is therefore an object of the present invention to provide a new and improved dice game incorporating two levels of horizontally placed tiles numbered 1 through 9, which singly or additively correlate to the indicia or pips revealed on a pair of dice after a throw.

It is another object of the present invention to provide a new and improved dice game that makes for a more enduring game (longer playing time) than the original Shut the Box Game.

A further object or feature of the present invention is a new and improved dice game that allows for more strategic scenarios than the original Shut the Box game.

The foregoing summary broadly sets out the more important features of the present invention so that the detailed description that follows may be better understood, and so that the present contributions to the art may be better appreciated. There are additional features of the invention that will be described in the detailed description of the preferred embodiments of the invention which will form the subject matter of the claims appended hereto.

Accordingly, before explaining the preferred embodiment of the disclosure in detail, it is to be understood that the disclosure is not limited in its application to the details of the construction and the arrangements set forth in the following description or illustrated in the drawings. The inventive apparatus described herein is capable of other embodiments and of being practiced and carried out in various ways.

As such, those skilled in the art will appreciate that the conception, upon which this disclosure is based may readily be used as a basis for designing other structures, methods, and systems for carrying out the several purposes of the present invention. It is important, therefore, that the claims are regarded as including such equivalent constructions as far as they do not depart from the spirit and scope of the present invention. Rather, the fundamental aspects of the invention, along with the various features and structures that characterize the invention, are pointed out with particularity in the claims annexed to and forming a part of this disclosure. For a better understanding of the present invention, its advantages and the specific objects attained by its uses, reference should be made to the accompanying drawings and descriptive matter in which there are illustrated the preferred embodiment.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

DRAWING REFERENCE NUMERALS

FIGS. 1-3C

Figure 1:
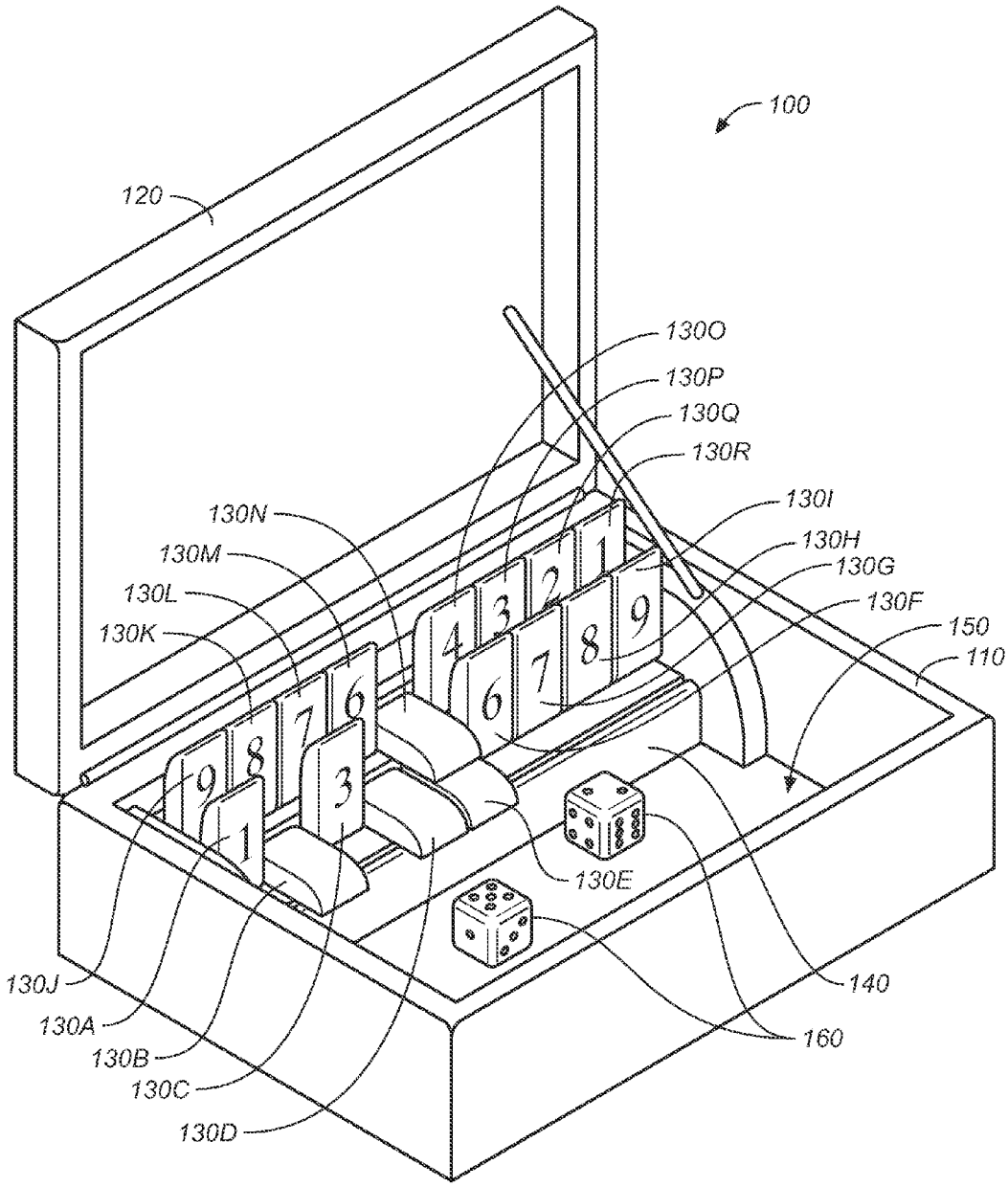
FIG. 1 is an upper right perspective view of the Two Level Shut the Box Game of the present invention, showing the gaming box, all numbered tiles, and the standard cubic dice employed in the game.

100 first preferred embodiment of inventive Two Level Shut the Box Game
110 gaming box
120 hinged lid
125 support rod
130A front row tile numbered 1
130B front row tile numbered 2
130C front row tile numbered 3
130D front row tile numbered 4
130E front row tile numbered 5
130F front row tile numbered 6
130G front row tile numbered 7
130H front row tile numbered 8
130I front row tile numbered 9
130J back row tile numbered 9
130K back row tile numbered 8
130L back row tile numbered 7
130M back row tile numbered 6
130N back row tile numbered 5
130O back row tile numbered 4
130P back row tile numbered 3
130Q back row tile numbered 2
130R back row tile numbered 1
140 horizontal support ledge
150 field area
160 dice
200 pivot rod
210 spacer
220 pivot rod fixing arc

DETAILED DESCRIPTION OF THE INVENTION

Referring to FIGS. 1 through 3C, wherein like reference numerals refer to like components in the various views, there is illustrated therein a new and improved Two Level Shut the Box Game, generally denominated 100 herein.

FIG. 1 illustrates a first preferred embodiment of the Two Level Shut the Box Game 100, comprising a gaming box 110 with a hinged lid 120 and a support rod 125. Within the gaming box 110 are two rows of 9 tiles, herein identified sequentially as 130A through 130 Q. The face of tiles 130A, 130B, 130C, 130D, 130E, 130F, 130G, 130H, and 130I bear numbers 1, 2, 3, 4, 5, 6, 7, 8, and 9, respectively, and are disposed side-by-side in a front row, while the face of tiles 130J, 130K, 130 L, 130M, 130 N, 130O, 130P, 130Q, and 130R bear numbers 9, 8, 7, 6, 5, 4, 3, 2, and 1, respectively, and are disposed side-by-side in a back row, which is parallel to and slightly elevated above the front row a distance approximately the thickness of the tiles. The positioning of the tiles is such that the front row of tiles, when in the vertical position, obscures the number inscribed on the face of the tile directly behind. Thus, in a vertical orientation front row tile 130A bearing the number "1", obscures back row tile 130J bearing the number "9". When the front row tile 130A is flipped down or tilted forward to a horizontal position, the face of back row tile 130J is revealed. This orientation and these options apply to all front/back row pairs and for each number in the sequence.

A support ledge 140 contacts the face of the front row tiles when they are flipped into the horizontal position. This maintains the tiles in a static horizontal position. Furthermore, the arrangement of back row tiles relative to the front row tiles is such that when back row tiles are flipped into a horizontal position, the face of the back row tiles rests on the back of a corresponding front row tile.

In the foreground of the gaming box, immediately in front of the tile rows, is a dice field area 150. This is the area where dice 160 are thrown during play.

Figure 2A:
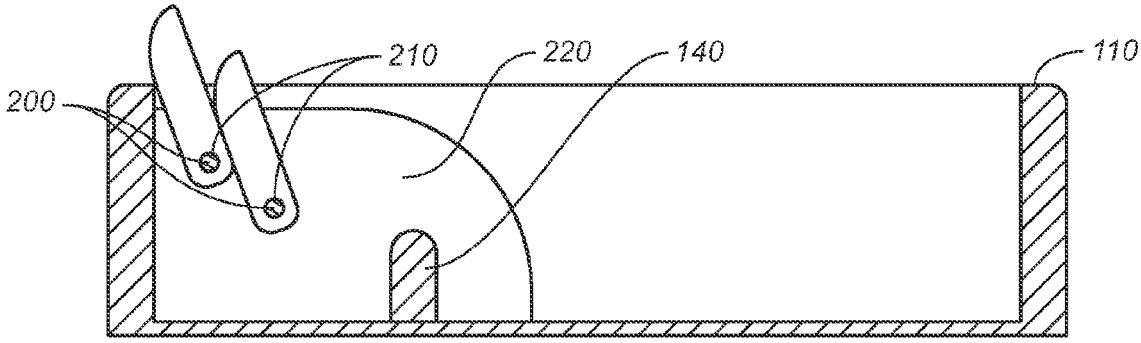
FIG. 2A is a cross-sectional side view in elevation showing a back (upper) row of tiles and a front (lower) row of tiles, all disposed in the vertical position.
Figure 2B:
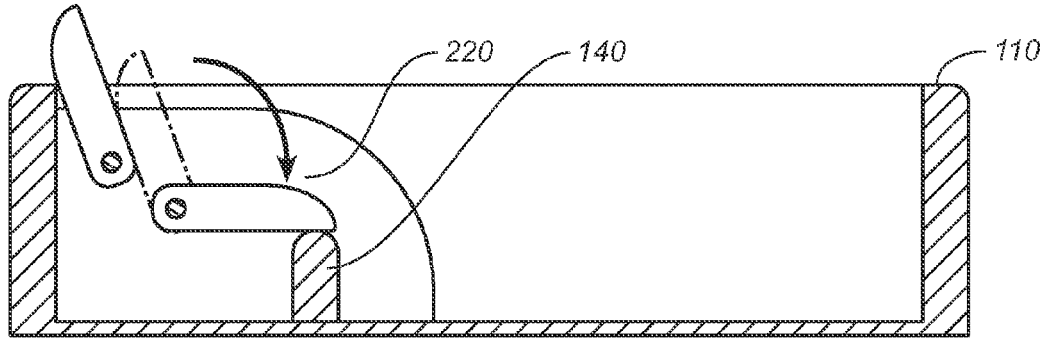
FIG. 2B is a cross-sectional side view in elevation showing a back row tile in the vertical position and a front row tile flipped down into the horizontal position.
Figure 2C:
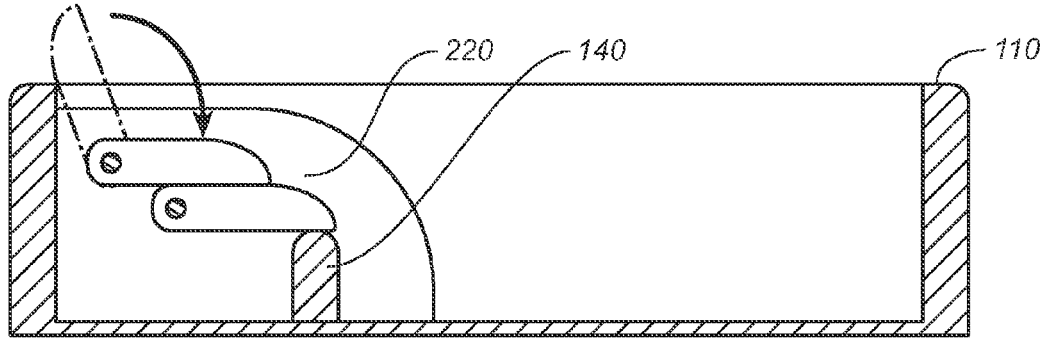
FIG. 2C is a cross-sectional side view in elevation showing both back and front row tiles tilted or flipped into the horizontal position.

Referring next to FIGS. 2A through 2C, within the gaming box 110 each tile in the series or row of tiles is pivotally attached to a pivot rod 200, thereby providing the option of placing tiles in either a vertical position, wherein the face number is exposed, or tipped forward in a horizontal position so that the tile rests upon the support ledge 140, which obscures the number on the tile face. A spacer 210 separates each adjacent tile in a row to facilitate movement of the tiles on the pivot rod 200. The pivot rod 200 is journaled at the left and right side walls of the gaming box 100 in a pivot rod fixing arc 220.

Figure 3A:
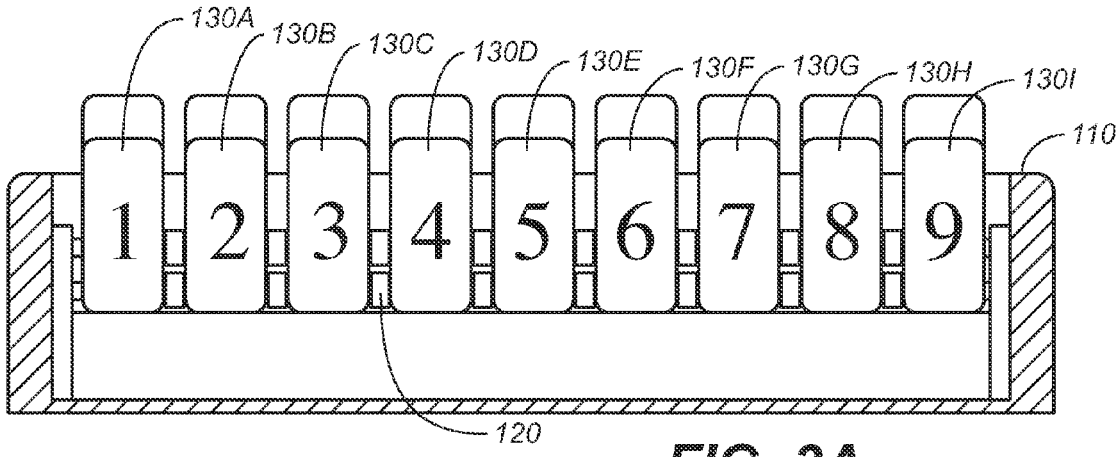
FIG. 3A is a cross-sectional front view in elevation corresponding to FIG. 2A.
Figure 3B:
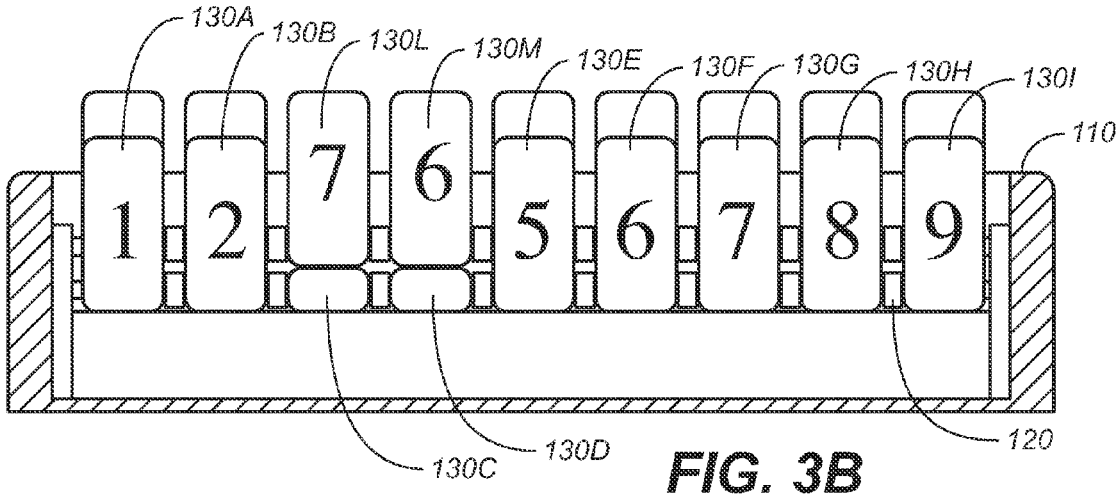
FIG. 3B is a cross-sectional front view corresponding to FIG. 2B.
Figure 3C:
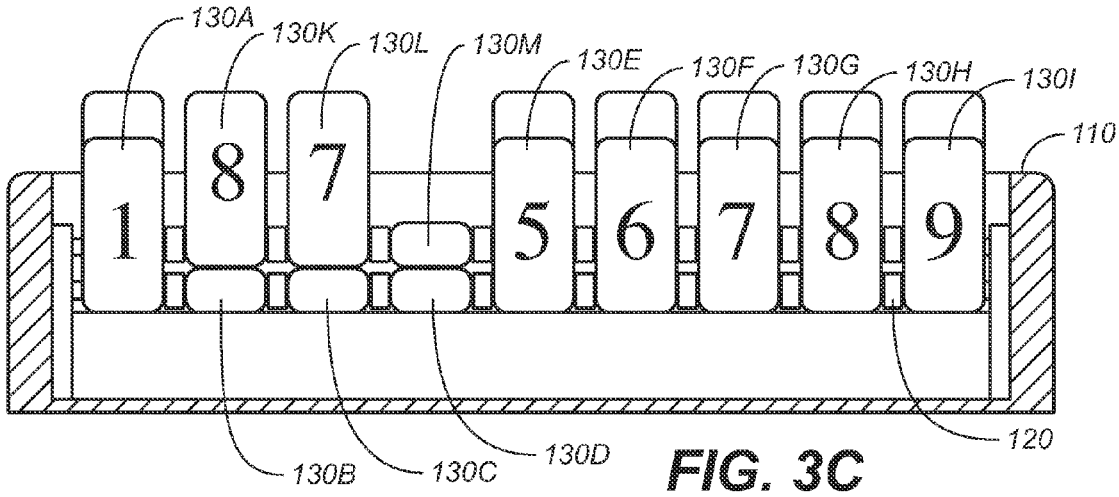
FIG. 3C is a cross-sectional front view corresponding to FIG. 2C.

Referring next to FIGS. 3A through 3C, the spacer 210 is visibly disposed between each tile. In FIG. 3A, tiles 130A, 130 B, 130C, 130D, 130E, 130F, 130G, 130H, and 130I bear numbers 1, 2, 3, 4, 5, 6, 7, 8, and 9, respectively, and are disposed side-by-side in a front row. They are shown in the vertical position, thus obscuring tiles in the back row.

In FIG. 3B, tiles 130C and 130D in the front row are tipped forward into the vertical position, thus revealing tiles 130L and 130M in the back row.

FIG. 3C is a front cross sectional view in elevation showing tiles 130B, 130C and 130D tipped forward in the horizontal position, thus revealing the face of tiles 130K and 130L. Tile 130M is tipped forward into the horizontal position, obscuring its face number.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Furthermore, it will be appreciated that the indicia on the tile faces need not comprise numbers. Indeed, arabic numerals are used generically herein to denote any kind of arbitrary mark that may correspond or map to a mark on a random number generator, such as dice. Indeed, artistic images, letters, colors, any of a number of suitable indicia could be employed without altering the fundamental functional aspects of the tiles and dice. If numbers are not employed, then rules for adding the dice indications must be devised, but such simple rules or algorithms are well known.

Finally, as earlier noted, additional rows of tiles may be included to add further complexity and strategic options to the game. Accordingly, it is contemplated that third, fourth, and perhaps fifth rows could be added, all without altering the rules of play or the fundamental character of the game. Each additional row is incorporated into the game, arranged and configured relative to the row immediately in front of it in precisely the same manner as the back row is arranged and configured relative to the front row.

Therefore, the above description and illustrations should not be construed as limiting the scope of the invention, which shall be defined by claims when and as filed.

What is claimed as invention is:

1. A dice game method, comprising the steps of:

providing a pair of conventional cubic dice bearing one or more pips on each face of said dice, said dice for use by two or more game players;

providing a game box, a plurality of linearly arrayed tiles with adjacent tiles in a side-by-side relationship to form a front row of tiles within the gaming box, each of the front row tiles having a face bearing a mark, wherein each of the front row tiles is pivotally disposed on first pivot means and may be selectively placed in either a vertical orientation so as to show the mark or a horizontal orientation so as to obscure the mark, a plurality of linearly arrayed tiles with adjacent tiles disposed in side-by-side relationship to form a back row of tiles within the gaming box, each of the back row of tiles having a face bearing a mark, wherein each of the back row tiles is pivotally disposed on second pivot means and may be selectively placed in either a vertical orientation or a horizontal orientation, and wherein the back row is disposed behind and above the front row such that each of the back row tiles is directly behind a corresponding front row tile, and such that, for any given pair of front row tile and corresponding back row tile, when any given tile in the front row of tiles is in the vertical orientation, the mark in the corresponding back row tile is obscured, and when any given tile in the front row of tiles is in the horizontal position while the back row tile is in the vertical orientation, the mark on the back row tile is revealed, and when both the front row tile and the back row tile are in the horizontal orientation, the marks of each of the front and back row tiles is obscured;

determining which of said players shall commence play;

commencing play by using the game box in the following manner and having a first player throw the dice and repeatedly throwing the dice until the player unable to continue, each throw of the dice proceeding as follows: If the total of the numbers on the standing tiles is equal to or less than 6, then the player has the option of using one or both dice; if the total of the numbers on the uncovered standing tiles is greater than 6, 7, 8, or 9, the player must use both dice, the player throws the die or dice into the box, adds the pips showing, and covers up a set of unique uncovered numbers that add up to the sum thrown, then repeating this process in subsequent throws and continuing until a throw of the die or dice show a total for which it is not possible to find a set of uncovered numbers, and thereupon scoring the sum of the numbers remaining uncovered, and passing the turn to the next player, wherein for each turn, once a numbered tile in the front row has been flipped forward to reveal a tile in the back row, the back row tile may then be used as a combination in the next throw, and further wherein a player wins if he or she succeeds in flipping all the numbers, and after each player has taken one turn, the winner of the round is the player with the lowest score.

* * * * *